United States Patent [19]

Chitre et al.

[11] Patent Number: 4,687,895

[45] Date of Patent: Aug. 18, 1987

[54] CONVEYORIZED MICROWAVE HEATING SYSTEM

[75] Inventors: Sanjeev R. Chitre, San Jose; Behrooz Minaee, Campbell, both of Calif.

[73] Assignee: Superwave Technology, Inc., Santa Clara, Calif.

[21] Appl. No.: 636,029

[22] Filed: Jul. 30, 1984

[51] Int. Cl.[4] ..... H05B 6/78

[52] U.S. Cl. ..... 219/10.55 A; 219/10.55 B; 219/10.55 F; 219/10.55 D; 219/10.55 M; 219/388; 426/241; 99/DIG. 14; 99/451

[58] Field of Search ..... 219/10.55 A, 10.55 R, 219/10.55 B, 10.55 F, 10.55 D, 10.55 E, 10.55 M, 385, 386, 388; 426/241, 243; 34/1; 99/451, DIG. 14

[56] References Cited

U.S. PATENT DOCUMENTS

| | | | |
|---|---|---|---|
| 3,699,899 | 10/1972 | Schiffmann et al. | 219/10.55 A X |
| 3,809,845 | 5/1974 | Stenstrom | 219/10.55 M |
| 3,881,403 | 5/1975 | Ingram et al. | 219/10.55 A X |
| 4,246,462 | 1/1981 | Meisel | 219/10.55 A |
| 4,307,277 | 12/1981 | Maeda et al. | 219/10.55 R |
| 4,314,128 | 2/1982 | Chitre | 219/10.55 B |

FOREIGN PATENT DOCUMENTS

| | | | |
|---|---|---|---|
| 52-30938 | 9/1977 | Japan | 219/10.55 M |
| 56-91436 | 7/1981 | Japan | 219/10.55 M |

*Primary Examiner*—Philip H. Leung

*Attorney, Agent, or Firm*—Harry M. Weiss & Associates

[57] ABSTRACT

A system for heating objects serially within a plurality of separate heating zones is described. Objects are placed on pallets and sequentially moved through the plurality of heating zones. In a preferred embodiment, the pallets are fabricated of a microwave absorptive material and sequentially moved through a plurality of microwave cavities. The microwave cavities are provided with a source of microwave energy which heats the pallets, and by conduction, the objects placed thereon.

17 Claims, 9 Drawing Figures

CONVEYORIZED MICROWAVE HEATING SYSTEM

BACKGROUND OF THE INVENTION

1. Field of the Invention

This invention is concerned with a device for controllably heating objects during a phase of a manufacturing operation.

2. Prior Art

In the electronics industry, it is often necessary to heat components during various phases of manufacturing operations. For example, infrared ovens are used to cure photoresists on silicon wafers and ribbons, ceramic substrates, printed circuit boards, and glass substrates, as well as to cure polymides/polyurethane coatings on such substrates. Such ovens are also used to drive out organic solvents in anti-reflection coatings, spray-on/spinners, dopant coatings, thick film pastes, silk-screen resists and emulsion coatings. Infrared ovens providing even higher temperatures are used for the sintering of thick film metal pastes such as aluminum, silver and palladium, the high temperature baking of silicon, ceramics and other substrates, the dopant drive-in for silicon substrates, and the drying of anti-reflection coatings, to mention only a few of the many uses of heat in various phases of manufacturing processes in the electronics industry. Many of the uses of heat in the processing of electronics components require that the processing temperature be profiled, i.e., the electronics components be put through a heating cycle in which the temperature is varied at different points within the cycle.

The use of ovens which radiate infrared energy to objects in order to heat the objects is accompanied by a number of shortcomings. One of these is the ability to accurately measure the temperatures actually reached by the objects being heated. For example, during the curing of polymide coatings on silicon in infrared ovens, it has been found that the actual temperatures can be 40 to 50 percent more than indicated by thermocouples as conventionally used. This can result in blistering and non-uniformity in the cured coatings, and is highly undesirable.

Another shortcoming is the large amount of energy required by infrared ovens and the concommitant heat loss to the environment during heating cycles which often require significant amounts of time.

A further shortcoming is the inadaptability of conventional heating methods to mass production techniques. While many, if not most, of the other steps in many manufacturing operations may be automated in a manner which employs assembly line techniques, the heating of objects as part of a manufacturing process remains essentially a batch process.

More rapid and efficient heating of objects has long been known to be a characteristic of the use of microwave energy for heating, the microwave energy being in the wavelength range of 300 MHz to 300 GHz. However, the ability of an object to be heated by direct coupling of microwaves into it depends on the composition of the object. Certain materials, such as silicon, are microwave absorptive and can be directly heated by microwave energy. Other materials are not microwave absorptive; such materials will not be appreciably heated as direct coupling of microwave energy into such materials does not occur or does not occur to a great enough extent. Quartz is an example of such a material.

As microwave energy represents a potentially clean, quick and efficient method of heating objects, it is an objective of the present invention to use microwave energy to heat objects during various phases of manufacturing processes. It is also an objective of the present invention to provide a heating system using microwave energy that can successfully heat, according to a predetermined temperature profile, both objects which are microwave absorptive, and those which are not. It is yet a further objective of the present invention to provide such a system which is easily adaptable to automated manufacturing techniques rather than restricted to essentially a batch mode of operation.

SUMMARY OF THE INVENTION

These and other objectives are achieved by providing a system in which the objects to be heated are placed on conveyorized pallets and moved sequentially through a series of adjacently placed microwave cavities which are provided with microwave antennas powered by individual magnetrons. The duty cycles of the magnetron power supplies are variable in order to control the rate of temperature increase as well as the peak temperature reached, so that objects may be heated to different temperatures in the different microwave cavities.

In the case where the objects to be heated are not highly absorptive of microwaves, the conveyorized pallets of the present invention are fabricated from a material which is highly absorptive of microwaves, such as silicon carbide. The objects to be heated are placed in contact with the silicon carbide pallets and are heated by conduction of heat from the silicon carbide pallets to the objects, and not directly by absorption of microwaves. Microwave energy couples very efficiently to silicon carbide so that the silicon carbide pallets and the objects are heated very efficiently in this manner.

To heat objects which are highly absorptive of microwaves, such as silicon, the conveyorized pallets are fabricated from a material which is not absorptive of microwaves, such as quartz, and such objects absorb the microwave energy directly.

In either case, the conveyorized pallets are intermittently stepped along their direction of travel to place the pallets, and hence objects placed on the pallets, serially within the plurality of microwave cavities provided along the path of the conveyorized pallets.

Two microwave radiating antennas are located in the lower portion of each microwave cavity and are supplied with microwave energy from a magnetron powered by a controllable magnetron power supply. The multimode microwave cavities are each provided with entrance and exit apertures having automated interlocked doors which prevent microwave leakage, heat loss, and the flow of gases between cavities when closed. These doors are opened to permit the conveyorized pallets to be transported into and out of the microwave cavities. While the pallets are being transported, no microwave energy is being radiated within the cavities, interlocks preventing the generation of such radiation while the doors over the entrance and exit apertures are opened.

Each microwave cavity provides its own gaseous environment, which may be necessary or desirable during the heating process, by means of gas inlet lines plumbed into the microwave cavity. Openings for the exhaustion of gases or vapors released during the heating of the objects and for the positioning of infrared detector cameras that may be used for temperature calibration and monitoring purposes are also provided.

Quartz plates which do not absorb microwave energy and hence do not interfere with the operation of a microwave cavity may be placed above the portion of each cavity where the pallet is located to separate the objects thereon from the upper surface of the microwave cavity. The quartz plates prevent the microwave cavity from being contaminated by any vapors which may be released by the objects being heated. This is advantageous in that the quartz plates may be more quickly and easily cleaned than the stainless steel surfaces of the microwave cavities themselves. In addition, the quartz plates reflect infrared energy.

Where the objects to be heated are microwave absorptive, and therefore pallets which are not microwave absorptive are used, the microwave cavities may be tuned to most efficiently couple energy into the object being heated by providing a short pulse of microwave energy to the object in the cavity and measuring the microwave energy in the pulse reflected by the object. From this measurement, the tuning of the microwave cavity for most efficient coupling of microwave energy into the object to be heated can be determined.

In the case where the objects to be heated are not highly microwave absorptive and highly microwave absorptive pallets made of, for example, silicon carbide are used, the microwave cavities are tuned to efficiently couple microwave energy into the silicon carbide pallet.

A precise determination of the temperature of objects placed on silicon carbide pallets used in the present invention can be made by attaching to the doors of the microwave cavities thermocouples which contact the silicon carbide pallets when the doors are closed. Since the objects placed on and in close contact with the silicon carbide pallets are heated by conduction from the silicon carbide pallets, the measurement of the temperature by thermocouples in contact with the pallets accurately monitors the temperature of the objects being heated. The measurement of the temperature by such a thermocouple takes place during the portion of the duty cycle of the power supply during which the magnetron is not generating microwaves.

In the present invention, sources of heat other than microwave energy may be used in order to heat the conveyorized pallets on which the objects are placed. For example, conveyorized pallets can sequentially move objects to be heated through a series of adjacent chambers provided with hot plates on which the pallets are rested in order to heat the objects placed on the pallets. The pallets for such configuration would be fabricated of a material which has a high thermal conductivity.

Other configurations are also described.

DESCRIPTION OF THE PREFERRED EMBODIMENT

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics and structural features attributed to forms of the invention first described also shall be attributed to forms later described, unless such characteristics obviously are inapplicable or unless specific exception is made.

The present invention will be described in detail in terms of a preferred embodiment using microwave radiation as a source of heat. This embodiment enables objects to be heated through a predetermined cycle in which different gaseous environments as well as temperatures for the objects are provided during different parts of the cycle.

Objects which are not absorptive or particularly absorptive of microwave radiation are heated by being placed into contact with a supporting member which is highly absorptive of microwave energy. Such objects are heated by conduction of heat from the support member to the objects.

Figure 1:
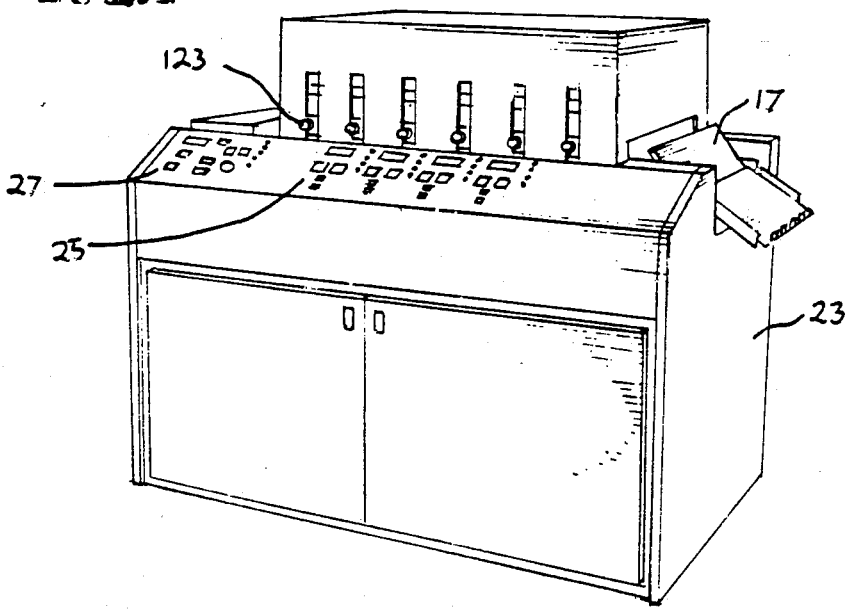
FIG. 1 is a perspective view of a preferred embodiment of the present invention in which several adjacently placed, separately powered, microwave cavities are traversable by conveyorized pallets holding objects to be heated.
Figure 2:
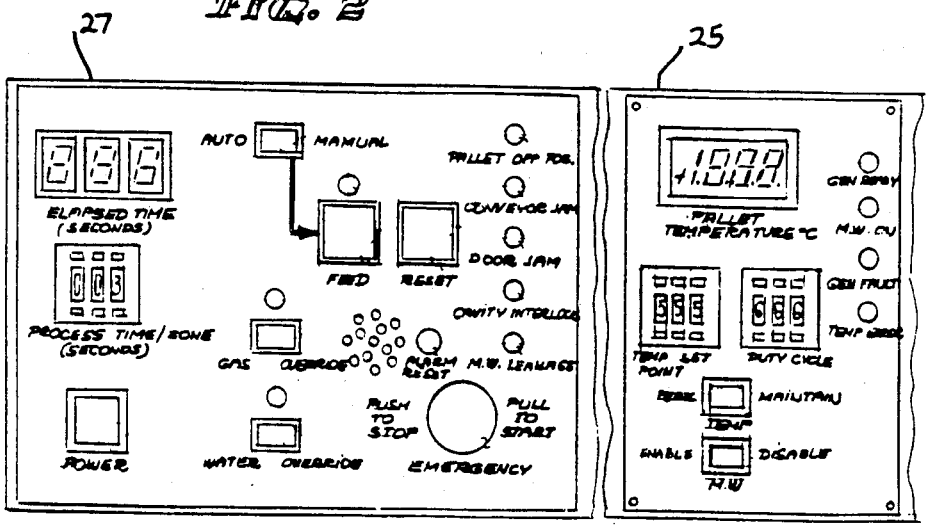
FIG. 2 is a closeup view of control panels used in the preferred embodiment of FIG. 1.

A perspective view of a preferred embodiment of the present invention is shown in FIG. 1. A general description of the overall operation of this embodiment of the present invention can be understood with reference to FIG. 3, which is a partially cut away perspective view of the embodiment shown in FIG. 1, and FIG. 4 which is a simplified, partially schematicized cross-sectional diagram of the preferred embodiment shown in perspective in FIGS. 1 and 3.

The preferred embodiment of the present invention comprises four adjacently placed microwave cavities or heating zones 11 arranged in a linear array. Adjacent each end of the array of microwave cavities 11 is located a purge chamber 13. A conveyorized pallet loop 15 having individual pallets 17 on which objects to be heated are placed traverses the microwave cavities 11 and purge chambers 13 through entrance and exit apertures 19 and 21, respectively, for each of the microwave cavities 11 and purge chambers 13. Objects placed on the individual pallets 17 of the conveyorized pallet loop 15 can be successively placed within microwave cavities 11 and purge chambers 13 by actuating the conveyorized pallet loop 15. The objects may then be serially heated within the individual microwave cavities 11 to desired temperatures.

A more detailed description of this preferred embodiment will now be presented with respect to FIGS. 1 through 6.

As seen in FIG. 1, a sheetmetal enclosure 23 serves to house the invention, including the several microwave cavities 11 in which the objects are heated. Enclosure 23 is provided, on a convenient exterior surface, with control panels 25 for regulating the temperature of each microwave cavity 11 and for monitoring the condition of the cavity 11 and the temperature of the objects being heated. An additional control panel 27, also provided on the exterior surface of enclosure 23, contains the controls used for controlling the movement of the conveyorized pallets 17 used for supporting and transporting the objects to be heated, as well as other controls and indicators.

Each of the adjacently placed microwave cavities 11 comprises an upper portion 29 and a lower portion 33. In the preferred embodiment, stainless steel is used to fabricate the top, bottom and side panels of both the upper portions 29 and the lower portions 33 of microwave cavities 11. The upper portions 29 of each of the microwave cavities 11 as well as the corresponding portions 35 of the purge chambers are fabricated as an upper assembly 39. Similarly, the lower portions 33 of the microwave cavities 11 and the adjacent microwave chokes 41 are fabricated as a lower assembly 43.

Figures 5, 6:
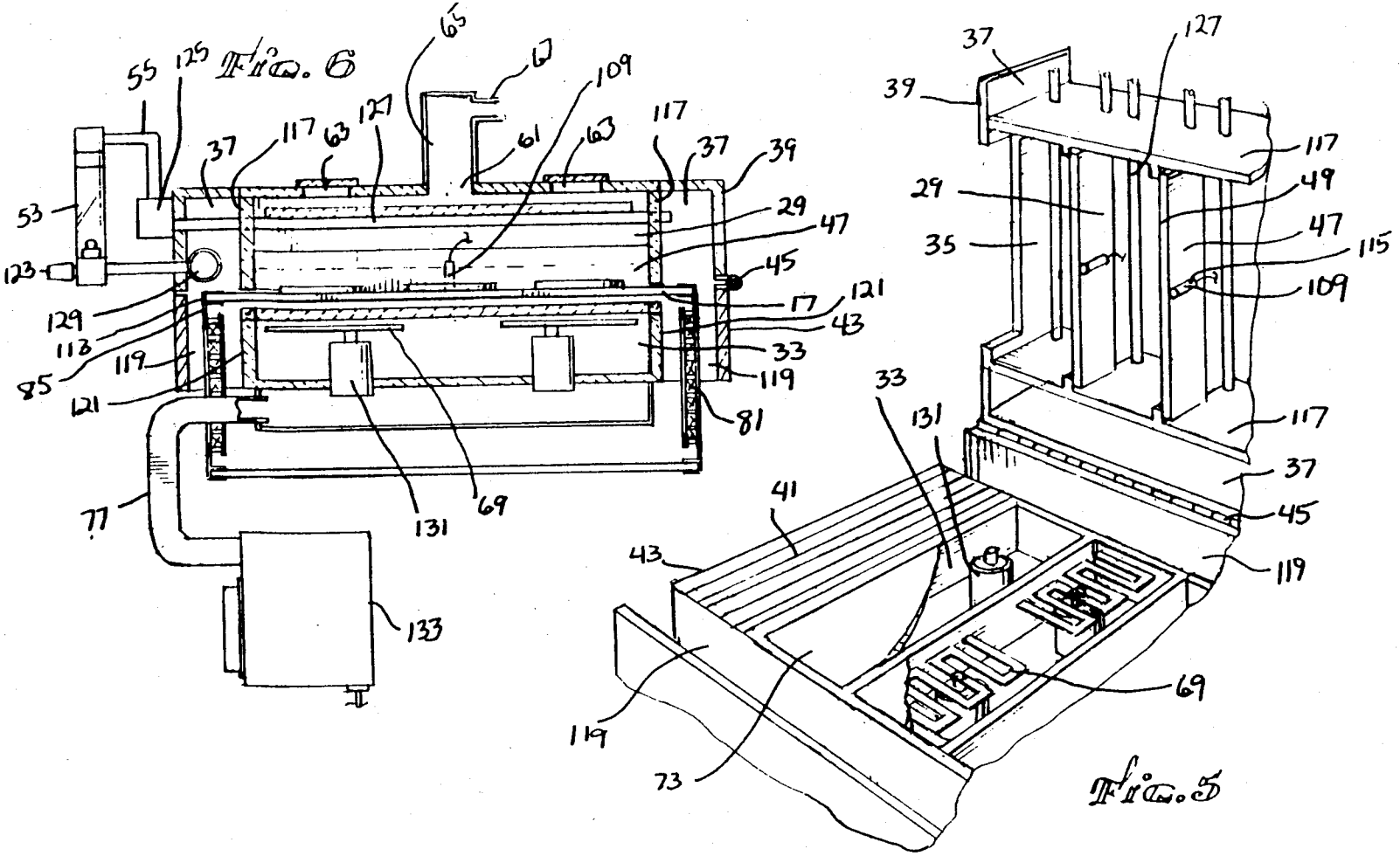
FIG. 5 is a simplified, partially cut away, perspective view of the microwave cavities used in the preferred embodiment of the present invention shown in FIG. 1.
FIG. 6 is a cross-sectional view of one of the microwave cavities used in the present invention taken along the lines 6—6 in FIG. 1.

As shown in FIGS. 5 and 6, upper assembly 39 has, extending along each side of the microwave cavities 11 and purge chambers 13, attenuation chambers 37 separated from the microwave cavities 11 and purge chambers 13 by wall members 117. Attenuation chambers 37 assist in preventing microwave energy from radiating into the environment. Similarly, lower assembly 43 has along its length on each side attenuation chambers 119 separated from the lower portion 29 of the microwave cavities 11 and the lower portions 33 of the purge chambers 13 by wall members 121 for the same purpose.

Upper assembly 39 and lower assembly 43 are connected along one side by piano hinge 45 which permits the microwave cavities 11 and purge chambers 13 to be opened. This easy access to the interiors of the microwave cavities 11 and purge chambers 13 enables the components therein to be cleaned, serviced, or replaced as necessary.

The upper portion 29 of each microwave cavity 11 has oppositely disposed entrance and exit apertures 19 and 21, respectively, which extend most of the width of the microwave cavity 11.

In the preferred embodiment, since the microwave cavities 11 and purge chambers 13 are adjacently placed, the exit aperture 21 of a purge chamber 13 or microwave cavity 11 actually forms the entrance aperture 19 of the next-in-line microwave cavity 11 or purge chamber 13. A vertically sliding door 47 is slideable across the entrance apertures 19 and exit apertures 21 to close off each microwave cavity 11 or purge chamber 13 from an adjacent microwave cavity 11 or purge chamber 13 or the outside environment, the bottom edge 49 of each door 47 abutting the top surface of a pallet 17. Small portions of the apertures 19 and 21 beneath the pallet 17 providing clearance distance for the pallet 17 are not closed off by the doors 17.

The vertical sliding doors 47 are each provided with a pneumatically operated control mechanism 31 activated by electrical signals. The stroke of this mechanism 31 is adjustable so that each door 47 opens only to the extent necessary to accommodate objects being transported between adjacent microwave cavities 11 or purge chambers 13. Vertical sliding doors 47 are controllable through controls on control panel 27 as will be explained.

In the present invention, each microwave cavity 11 and purge chamber 13 may be provided with its own controlled gaseous environment. In the preferred embodiment shown in FIGS. 1 through 6, the same gas is provided through a manifold 129 running along the length of one of the attenuation chambers 37 in the upper assembly 39 to individual gas flow controllers 53 corresponding to each microwave cavity 11 and purge chamber 13. Each gas flow controller 53 is provided with a control 123 accessible from the front of the system so that the flow rate of gas into each of the microwave cavities 11 and purge chambers 13 may be individually selected. From each gas flow controller 53, gas flows through tubing 55 into manifold block 125. Two perforated tubes 127 are connected to manifold block 125 and extend inside and across the width of each microwave cavity 11 or purge chamber 13 a short distance from the top of microwave cavity 11 or purge chamber 13. Through the perforations in perforated tubes 127, gas is provided to the microwave cavity 11 or purge chamber 13 at a flow rate determined by the setting of control 123.

Each microwave cavity 11 may be lined with a thermally insulating layer (not shown) which helps to keep any heat generated within the microwave cavity 11 from radiating outside that cavity. This layer may be comprised of a material such as aluminum oxide which does not appreciably absorb microwaves.

In addition, a quartz plate 59 is removably secured in microwave cavity 11 above the perforated tubes 127. The purpose of quartz plate 59 is to prevent the top panel of microwave cavity 11 from being contaminated by deposits resulting from vapors emitted during the heating of objects in microwave cavity 11. It is easier to clean quartz plate 59 of such contaminants or to replace it than it is to clean the stainless steel top panel of the upper portion 29 of microwave cavity 11.

Since quartz is transparent to microwave radiation, no interference with the operation of microwave cavity 11 results from the use of quartz plate 59. Quartz plate 59, however, does assist in keeping the heat generated in the microwave cavity 11 within the cavity.

The upper portion 29 of each microwave cavity 11 is provided along its top with a center port 61 and two end ports 63. Over center port 61 is an exhaust flue 65 which is connected through tube 67 to an exhaust system, not shown. Exhaust flue 65 is used to remove vapors emitted by objects being heated in the microwave cavity 11 as well as gases supplied through gas flow controller 53 to the microwave cavity 11 in order to provide a required controlled environment. Space around and above quartz plate 59 permit exhaust flue 65 to operate.

In the lower portion 33 of each microwave cavity 11 is located a pair of microwave radiating antennas 69, the posts 131 for which extend through the bottom side of the microwave cavity 11. The antenna configuration is selected to provide to an appreciable extent uniform distribution of microwave energy in the pallet 17 located above the antennas 69 so that the pallet 17 is heated uniformly. Any number of antenna configurations could suffice, and in particular, the number of antennas used in each microwave cavity 11 need not be two, but may be one or three, or some other number. In some applications, it is envisioned that a non-uniform distribution of heat might be desired in the pallet 17, so that an appropriate antenna configuration would be selected.

A magnetron 133 powered by a one kilowatt magnetron power supply 75 is used to provide power to the microwave radiating antennas 69 in each cavity 11. A waveguide 77 which extends from the magnetron 14 to beneath the bottom of microwave cavity 11 couples the power from the magnetron 133 to the microwave radiating antenna 69. The rate of temperature increase of the pallet 17 and object being heated, as well as the peak temperature reached by the pallet 17 and the object, are controlled by regulating the duty cycle of the magnetron power supply 75 using controls on control panel 25. As each microwave cavity 11 is provided with its own magnetron power supply 75, a different peak temperature as well as rate of increase of temperature may be provided for each microwave cavity 11.

In the preferred embodiment, the temperature which it is desired that the pallet attain may be set with the "TEMP. SET POINT" control on control panel 25 for each microwave cavity 11. The "TEMP." selector switch may be switched to either the "PEAK" or "MAINTAIN" position. In the "PEAK" position, the magnetron power supply 75 shuts off when the pallet temperature reaches the temperature selected with the "TEMP. SET POINT" control. In the "MAINTAIN" mode, once the selected temperature is reached by the pallet 17, the duty cycle of the magnetron power supply 75 is automatically regulated to maintain that temperature. In addition, the "DUTY CYCLE" control on control panel 25 allows the duty cycle of the magnetron power supply 75 to be selected so that the rate of increase in pallet temperature is thereby effectively controlled. Once the selected temperature is achieved, the "DUTY CYCLE" control is disabled, the temperature either being maintained through automatic regulation of the duty cycle in the "MAINTAIN" mode, or the magnetron power supply 75 being shut off in the "PEAK" mode.

It is within the scope of the invention to provide other temperature profiles within any of the microwave cavities 11. For example, the magnetron power supply 75 for a microwave cavity 11 could be controlled to provide a heating profile in which several distinct peak temperatures are achieved during the time that the object remains in the particular microwave cavity 11. As another alternative, one or more of the microwave cavities 11 may not be operated during a heating cycle.

A thermal insulating lining layer (not shown) similar to that described for the upper portion 29 lines the lower portion 33 of microwave cavity 11. Additionally, a thermal insulator 73 separates the lower portion 33 from the upper portion 29 of the microwave cavity 11. This thermal insulator 73 is not appreciably absorptive of microwave radiation, and does not interfere with the operation of the microwave cavity 11. A flow of cooling air may be introduced into lower portion 33 of microwave cavity 11 in order to help keep the antennas 69 cool.

The purge chambers 13 located on each end of the array of microwave cavities 11 are similar in size and configuration to the microwave cavities 11. Each purge chamber 13 comprises an upper portion 35 similar to the upper portion 29 of each microwave cavity 11 and is provided a gas flow controller 53 and associated components as provided with respect to each microwave cavity 11. Each purge chamber 13 may be provided with an exhaust flue similar to that provided for each microwave cavity. The lower portion 79 of each purge chamber 13 contains a microwave choke 41 comprised of a spaced array of metal plates 111. Choke 41 attenuates microwave radiation entering the purge chamber 13 from the adjacent microwave cavity 11.

The conveyorized pallet loop 15 comprises a plurality of adjacent pallets 17 which are coupled at their ends to a pair of conveyor chain loops 81. Each pallet 17 comprises a thin, flat, rectangular sheet of silicon carbide having very small cutout portions at its corners for mounting purposes.

The length of each pallet 17 is approximately equal to the length of microwave cavity 11 (measured in the direction in which pallets 17 travel through microwave cavities 11) while the width of pallet 17 is on the order of the width of microwave cavity 11. In fact, pallet 17 extends beyond the ends of the microwave cavity 11 between attenuation chambers 37 in the upper assembly 39 and corresponding attenuation chambers 119 in the lower assembly 43 as can be seen in FIG. 6.

The microwave energy absorbed by the silicon carbide is transformed into infrared energy, heating the silicon carbide pallet 17, and by conduction, objects placed in contact with the silicon carbide pallet 17. Silicon carbide is selected for the pallet materials as it absorbs microwaves very efficiently and is a material which can be cast into pallets of the dimensions preferred for use in the present invention. Other materials, such as graphite, silicon and other carbon based materials have microwave absorptivities which would render them suitable for use as pallets 17, but are not presently as practically formable into pallets having suitable dimensions as silicon carbide.

The top surface of pallet 17 is preferably very flat in order to enhance the conduction of heat generated in pallet 17 into objects having a flat surface placed thereon. For objects having other surface configurations, the top surface of pallet 17 is preferably configured to conform to that surface in order to enhance the conduction of heat into such objects.

Figure 9:
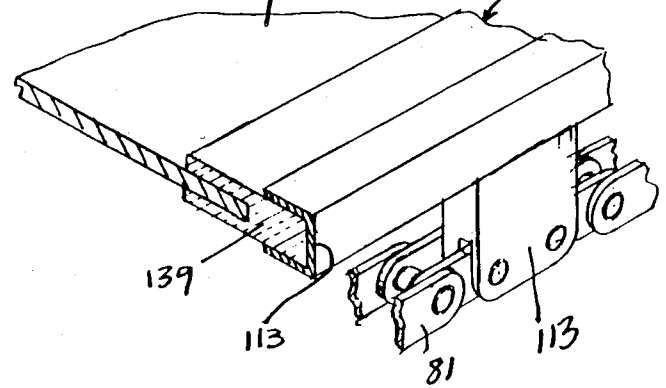
FIG. 9 is a view of an alternate embodiment of a pallet having thermally insulating members separating the thermally conducting central portion of the pallet from the components used to couple the pallet to the conveyorized drive system.

Other configurations of pallets are within the scope of the present invention. An alternate pallet 135 is shown in FIG. 9. Pallet 135 comprises a central portion 137 formed of a material such as silicon carbide and insulating members 139 located on each side of the central portion 137 and between the central portion 137 and the channel members 113 or other means used to support the pallet 135. Thermal insulating members 139 inhibit the flow of heat out of the microwave cavity 11.

Figure 8:
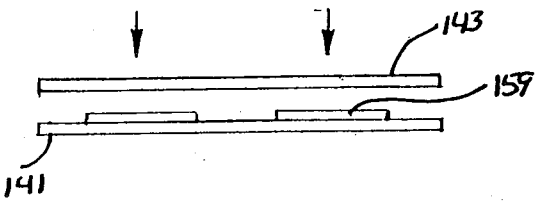
FIG. 8 shows schematically an alternate embodiment of a portion of the present invention in which an object placed on a pallet is contacted by a member on its top surface in order to conduct heat into the object therethrough or to apply required pressure.

Another pallet configuration is shown schematically in FIG. 8. This pallet configuration comprises a pallet 141 which supports the object 159 to be heated in a manner similar to that which has been described and a top member 143 which is placeable into contact with the top surface of the object 159. The purpose of top member 143 is to provide heat to an object through the top surface of the object, to provide pressure on the object, or to provide both heat and pressure. Member 143 may be formed of the same material as is pallet 141, in which case heating is accomplished by conduction. Bolts or other mechanisms may be employed to attach top member 143 to the pallet 141 with the desired pressure. Alternatively, top member 143 may be attached to the interior of the microwave cavity 11 or to the vertical sliding doors 47. In the latter case, top member 143 may be placed on the top of the object to be heated simultaneously with the closing of the vertical sliding doors 47. In some configurations, it may be desired to fabricate top member 143 from a thermally insulating material, so that primarily pressure, and not heat, is applied by top member 143.

The aforesaid pallet configurations may also be employed in systems made according to the present invention in which the source of heat is other than microwaves, as well as in the other configurations described herein or otherwise within the scope of this invention.

Pallet 17, in the preferred embodiment, is supported at each end by insertion into a channel member 113 which has a length approximately equal to the length of pallet 17. Pallet 17 is secured within channel member 113 by insertion of set screws (not shown) through the ends of channel members 113. The set screws correspond to very small cutout portions at the corners of the pallet 17.

A connecting member 85 connects each channel member 113 to one of the pair of conveyor chain loops 81.

Each conveyor chain loop 81 comprises a plurality of chain elements connected in a continuous loop placed about a first sprocket 87 and a second sprocket 89. The pair of conveyor chain loops 81, the first sprockets 87 and the second sprockets 89 are mutually parallel. The first sprockets 87 are connected by an axle 93 to form a first rotable sprocket assembly 95 located beyond one end of the line of microwave cavities 11 and purge chambers 13 and the second sprockets 89 are connected by an axle 97 to form a second rotable sprocket assembly 99 located beyond the other end of the line of microwave cavities 11 and purge chambers 13 so that conveyor chain loops 81 move in unison. One side of each conveyor chain loop 81 traverses the length of an attenuation chamber 119 in the lower assembly 43 adjacent the microwave cavities 11 and purge chambers 13, as shown in FIG. 6.

Figure 4:
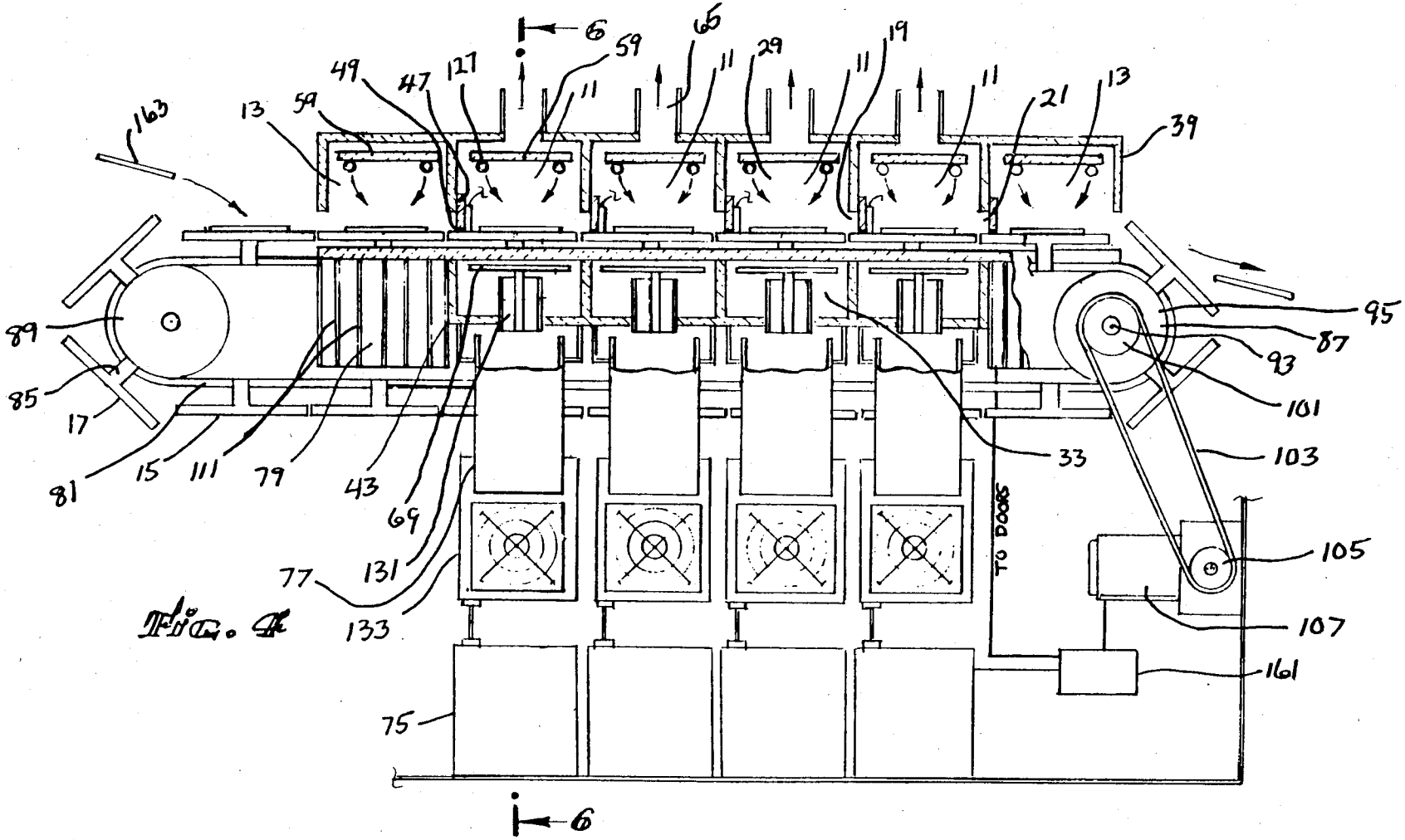
FIG. 4 is a simplified, partially schematicized cross-sectional view of the preferred embodiment of the present invention shown in FIG. 1.

As shown in FIG. 4, a drive sprocket 101 is connected to the axle 93 coaxially with the first sprockets 87. Drive chain loop 103 connects drive sprocket 101 with motor sprocket 105. Motor sprocket 105 is connected to the output shaft of stepping motor 107. The adjacently placed pallets 17 are moved in a loop path by activation of stepping motor 107.

Figure 3:
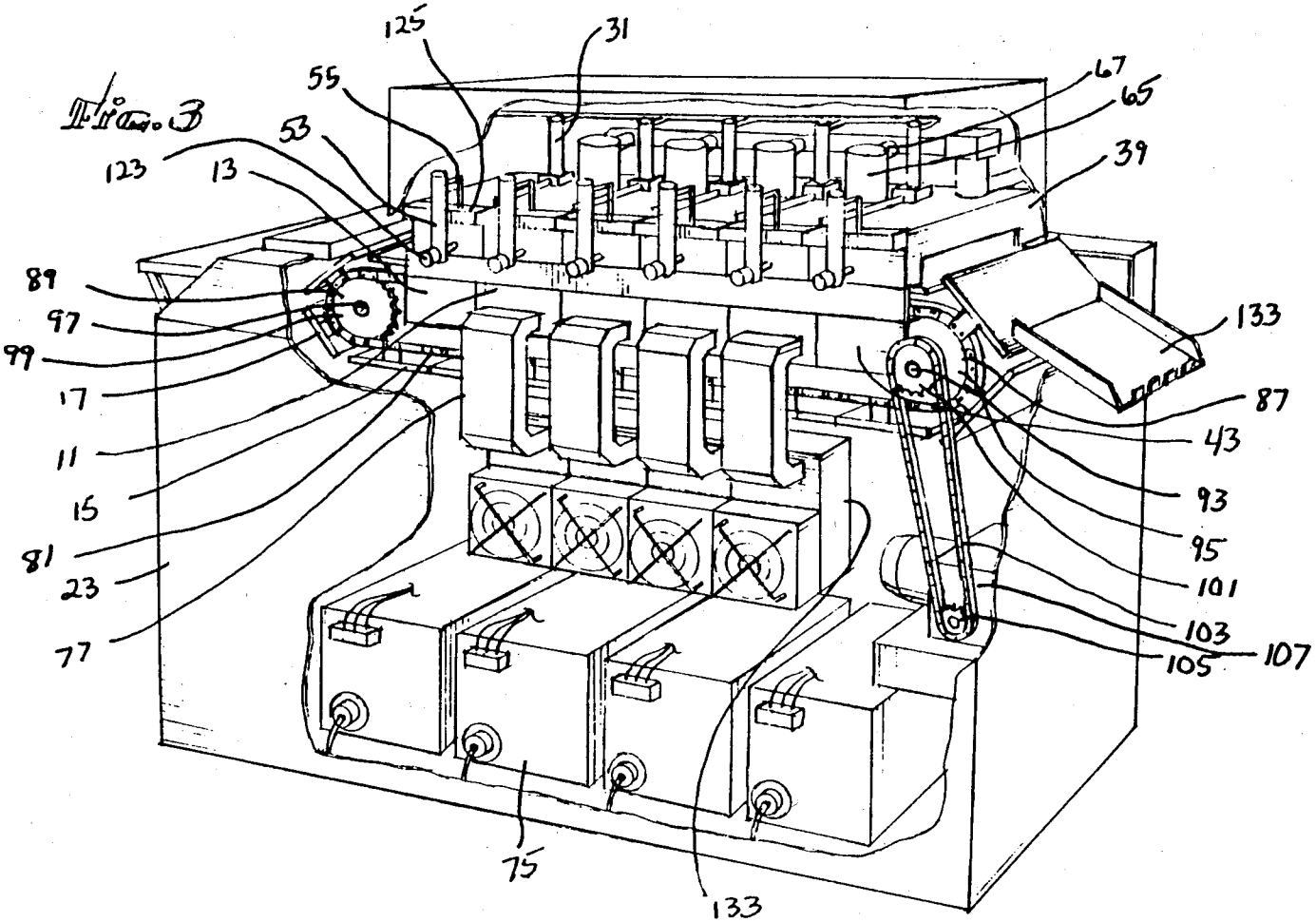
FIG. 3 is a partially cut away view of the preferred embodiment of the present invention shown in FIG. 1.

The activation of stepping motor 107 is regulated by controls on control panel 27. As shown in FIG. 3, the "PROCESS TIME/ZONE" control can be set by means of a thumbswitch for the amount of time each pallet 17 is to remain in a microwave cavity 11 or purge chamber 13. The "ELAPSED TIME" indicator is the display of a digital timer that counts the total time that the pallets remain in each microwave cavity 11 or purge chamber 13 after the start of a heating cycle in each cavity 11.

With the mode switch in the "MANUAL" position the "FEED" switch may be pressed, advancing the pallets 17 a distance equal to the length of a microwave cavity 11 or purge chamber 13. When the mode switch is switched to "AUTO", the pallets 17 are automatically advanced a distance equal to the length of a microwave cavity 11 or purge chamber 13 after the amount of time set by adjustment of the "PROCESS TIME/ZONE" control has elapsed.

The control circuit 161 that advances the pallets also controls the vertical sliding doors 47, opening them prior to the advance of the pallets 17 and closing them after the pallets 17 have completed their movement to the next succeeding position, as well as controls the microwave power supplies through control panels 25 and 27 and various interlocks.

The temperature of an object being heated in each of the microwave cavities 11 of the present invention is monitored by means of a thermocouple 109 attached to vertical sliding door 47. When vertical sliding door 47 is closed, the bottom door edge 49 bears against pallet 17 and the thermocouple 109 is brought into contact with pallet 17. Since the object placed on pallet 17 is heated by conduction of heat from pallet 17 to the object, an accurate indication of the temperature of the object being heated is achieved by measuring the temperature of the pallet 17. The measurement of the temperature of the pallets 17 by the thermocouple 109 takes place during the portion of the duty cycle that the magnetron power supply 75 is shut off. A steel tube 115 surrounds thermocouple 109 in order to shield it from microwave radiation.

A cooling plate 133 is located beyond the second purge chamber 13 through which the pallets 17 pass after being in the microwave cavities 11. Cooling plate 133 is located adjacent the path of the pallets 17 so that objects 163 on a pallet 17 which begins tilting downward as the conveyorized pallet loop 15 advances slide off the pallet 17 onto the cooling plate 133, from which they may be removed by manual or automatic methods. Cooling plates or other means for cooling may also be used to lower the temperature of the pallets 17 prior to their advancing to the area adjacent the entrance to the first purge chamber 13.

The system of the preferred embodiment of the present invention can be used to heat objects through a cycle in which different temperatures and/or gaseous environments are to be provided during different parts of the cycle. A first object 163 to be heated is placed on a pallet 17 of the conveyorized pallet loop 15 prior to the pallet 17 entering any of the microwave cavities 11 or purge chambers 13. The object 163 is placed on pallet 17 in a manner to maximize its contact with the surface of pallet 17. The object may be advantageously positioned by presently known autoload techniques or manually on pallet 17. One method is to locate a door such as the vertical sliding door 47 used on the microwave cavities 11 before the first purge chamber 13 and to use the door edge 49 as a guide for placement of the object when the door is closed.

Once a first object is properly positioned on pallet 17, vertical sliding doors 47 open and conveyorized pallet loop 15 is driven by stepping motor 107 so that the pallets 17 advance a distance equal to the length of the microwave cavities 11 and purge chambers 13, thereby placing the pallet 17 having the first object thereon to be heated within the first purge chamber 13. The vertical sliding doors 47 are then closed. Any required gas flow in the first purge chamber 13 is controlled by gas flow controller 53 to provide the desired environment.

During the time that the first object 163 is within the first purge chamber 13, a second object 163 may be placed on the pallet 17 following that on which the first object 163 is positioned in the same manner as the first object 163 was placed.

After a predetermined period of time equal to the amount of time that the first object and all succeeding objects are to remain in each of the microwave cavities 11, vertical sliding doors 47 open and stepping motor 107 advances the conveyorized pallet loop 15 to place the pallet 17 containing the first object 163 to be heated within the first microwave cavity 11 and the second object 163 within the first purge chamber 13. The vertical sliding doors 47 are then closed bringing the thermocouples 109 into contact with the pallets 17. The magnetron 133 for the first microwave cavity 11 is enabled so that microwave energy is supplied through the corresponding waveguide 77 to the antennas 69 for the first microwave cavity 11. Antennas 69 radiate microwave energy into the first microwave cavity 11 to heat the pallet 17 therein and, by conduction through the pallet 17, the object thereon to a temperature and at a rate determined by the controls on control panel 25. Simultaneously, any gaseous environment that may be required in first microwave cavity 11 as well as the first purge chamber 13 is provided through the corresponding gas flow controllers 53.

During this time, a third object 163 may be placed on the pallet 17 following that on which the second object 163 was placed in the same manner as has previously been described.

After the predetermined period of time that the pallets are to remain in each of the microwave cavities 11 and purge chambers 13 has passed, the vertical sliding doors 47 are opened and the stepping motor 107 again advances the conveyorized pallet loop 15 a distance equal to the length of one pallet, placing the third object 163 in the first purge chamber 13, the second object 163 in the first microwave cavity 11 and the first object 163 in the second microwave cavity 11. The doors are again closed and the gas flows for the first purge chamber 13 and first and second microwave cavities 11 are activated along with the magnetron power supplies 75 for the first and second microwave cavities 11. As has been described, each of the magnetron power supplies 75 is separately controlled to provide within the corresponding microwave cavity 11 the desired temperature, which may or may not be equal to the temperature desired in any of the other microwave cavities 11.

In a similar manner, objects 163 may be continually placed upon the pallets and sequentially subjected to the different environments of the microwave cavities 11 and purge chambers 13.

In order to heat all objects 163, including the first object 163, uniformly, it is usually preferable to activate all of the microwave cavities 11 when the first object 163 has been placed into the first purge chamber 13 in order that the microwave cavities 11 become preheated through radiation of infrared energy by the pallets 17 within those cavities 11, as such will undoubtedly be the condition of the microwave cavities 11 for the objects following the first object.

The second purge chamber 13 may be used to provide a flow of gas in order to cool each object after the completion of the heating cycle, in addition or instead of the cooling plate 133 previously described.

While the operation of the preferred embodiment of the present invention has been generally described, it will be appreciated that the various sequences of operations, involving the enabling of the magnetron power supplies 75, the movement of the conveyorized pallet loops 15, and the operation of the vertical sliding doors 47 may all be controlled by a master timing circuit 161 so that the entire operation is automatic. In addition, various interlocks may be employed to prevent the magnetron power supplies 75 from being enabled or to shut them down should a condition warranting such occur, e.g., a failure or inadvertent opening of one of the vertical sliding doors 47. Various embodiments of the electronic circuits to control the system of the present invention would readily occur to those skilled in the art, and consequently no detailed description of such circuits or their operation is provided herein.

Figure 7:
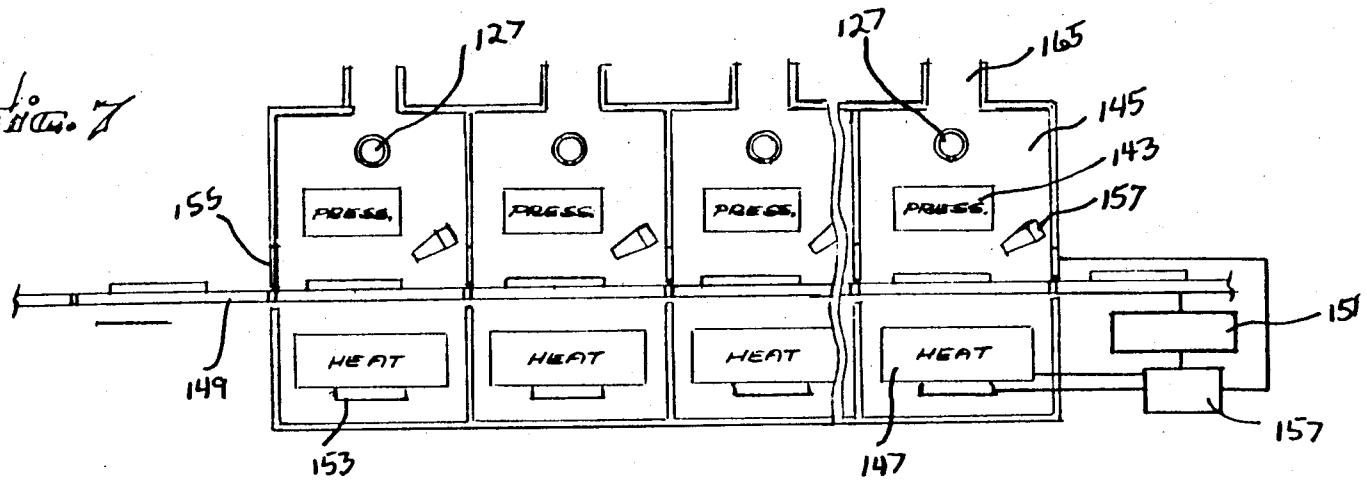
FIG. 7 is a schematic view of another possible embodiment of the present invention.

Other configurations in which the source of heat is other than microwave radiation are within the scope of the present invention. FIG. 7 is a schematic diagram of a possible embodiment in which the source of heat may be microwave radiation or other than microwave radiation. In FIG. 7, a plurality of heating zones 145 each independently provided with a heat source 147 is shown. Moveable pallets 149 fabricated of a thermally conducting material support the objects to be heated and are sequentially placeable within the various heating zones 145 by a pallet drive system 151. The heat source 147 is shown schematically as being beneath the pallet 149 within the heating zone 145, but it may be located either below or above such pallet, or may comprise two or more sources located both below and above the pallet 149. An infrared lamp or other radiator of infrared energy, a RF heating means, a resistance heater, microwave antennas placed beneath and/or above the pallets 147, and a hot plate are but a few of the possibilities of heat source 147.

When a hot plate is used as the heat source 147, a mechanism 153 to raise and lower the hot plate 147 may be employed, so that the hot plate 147 is lowered out of contact with the pallet 149 when the pallet 149 is being transported by the pallet drive system 151 into and out of heating zones 145. After the pallet drive system 151 has placed the pallets 149 in the heat zones 145, the mechanism 153 raises the hot plate 147, placing it in contact with the pallets 149. Mechanism 153 may be controlled by the same timing circuit 157 which controls the pallet drive system 151 and the opening of any doors 155 which may be employed at the entrance and exit apertures of the heating zones 145. Alternatively, a pallet drive system 151 may be employed which lowers a pallet 149 after it has been transported into a heating zone 145 and raises it at the end of the heating cycle before the pallet 149 is transported into the next heating zone 145.

In the embodiment illustrated in FIG. 7, a spray nozzle 157 is employed so that coating or curing material, or other substances may be sprayed onto the objects being heated before, during, or after the heating cycle. The operation of spray nozzle 157 may be controlled by the same timing circuit 157 which controls the pallet drive system 151 or may be controlled by a circuit responsive to the measurement of temperature of an object being heated or of the temperature of pallet 149. An exhaust flue 165 is provided. Alternatively, a vacuum pumping system may be connected.

The system of FIG. 7 may employ heating zones 145 of varying sizes. As a most simple example, one or more of the heating zones 145 may have lengths which are multiples of the lengths of the smallest heating zone 145. In such event, a pallet would remain in such larger heating zones 145 an amount of time approximately equal to the multiple by which such heating zones 145 are larger than the smallest heating zone 145 multiplied by the amount of time that the pallet 149 remains in the smallest heating zone 145.

Alternatively, more complex pallet drive systems 151 may be employed which vary the amount of time that the pallets 149 remain in different heating zones 145 even when the heating zones 145 are of the same length. In such a system, the pallets 149 would not move at all times in unison or at the same rate.

While the present invention has been described in terms of a preferred embodiment and other configurations useful for heating objects which do not appreciably absorb microwaves themselves, the present invention also provides a system for controllably heating objects which do appreciably absorb microwave energy.

In such a system, rather than pallets of silicon carbide, pallets made of a material which is not appreciably absorptive of microwaves are used. Also, since the pallets are not being heated, the thermocouples 109 in the preferred embodiment described above would not be used. However, a calibrated infrared camera may be positioned above one of the end ports 63 located in the top of the microwave cavities 11 and directed toward the objects being heated in order to measure temperature.

In addition, the frequency at which microwaves most efficiently couple into the object being heated can be selected as the frequency of operation of the magnetron. This frequency can be determined for each different type of object being heated by causing the magnetron to emit a short burst of microwave energy over a range of frequencies and measuring the energy reflected by the object as a function of frequency, the desired frequency being one for which reflected power is a minimum, indicating maximum coupling of microwave energy into the object. The pulse of microwave energy used to make such a determination is of short enough duration that no practical heating effect of the object is obtained. Thereafter, the system may be used to heat such objects in a manner similar to that described above, with the magnetrons tuned to the frequency determined to be an efficient frequency for coupling of microwave energy into the object.

Alternatively, the microwave cavities may be tuned in order to more efficiently couple microwave energy into objects being heated without changing the frequency of operation of the magnetrons by changing the impedence of the antennas, by providing a moveable short at the end of the waveguide, or by changing the effective dimensions of the microwave cavity, such as by changing the height of the antenna. Such methods of tuning microwave cavities are preferrable from the point of view of economics, as magnetrons which operate at single frequency are much less expensive than tunable magnetrons.

We claim:

1. A conveyorized heating system, comprising:

a plurality of adjacent microwave cavities;

a microwave radiating means for independently, selectively radiating microwave energy in each of said cavities;

at least one pallet means for supporting an object to be heated;

a conveyance means for transporting said at least one pallet means sequentially through said plurality of adjacent cavities;

a selectively operable, microwave and environmentally sealing closure between adjacent pairs of said cavities, closing of said closure permitting independent and arbitrarily different environmental and microwave conditions within ones of said adjacent pair of cavities; and opening means, cooperating with said conveyance means, for selectively and time sequentially opening said closure to permit passage therethrough of said at least one pallet means, said at least one pallet means operably integral to said conveyance means, having conveyor loop means, is made of a microwave absorptive material, said microwave absorptive pallet means directly contacts a not highly microwave absorptive object to be heated thereon which is to be heated by conduction of heat from said microwave absorptive pallet means which is heated by said radiated microwave energy as said microwave absorptive pallet means is transported through each cavity.

2. A conveyorized heating system as in claim 1 wherein said pallet is fabricated of silicon carbide.

3. A conveyorized heating system as in claim 2 wherein said means for independently, selectively supplying microwave energy to each said cavity comprises separate means corresponding to each said cavity.

4. A conveyorized heating system as in claim 3 wherein said plurality of microwave cavities are linearly arranged adjacent to each other, the exit openings and entrance openings of adjacent cavities coinciding, and wherein said entrance and exit openings are provided with closeable doors.

5. A conveyorized heating system as in claim 4 wherein each said cavity comprises a top portion located above said at least one pallet when said pallet is transported into said cavity and a bottom portion located below said pallet.

6. A conveyorized heating system as in claim 5 wherein said system further comprises a means for adjusting the frequency of the microwave energy supplied to said microwave radiating means when said object is in said cavity so that the microwave energy in said cavity is efficiently coupled to said object.

7. A conveyorized heating system as in claim 6 wherein said means for adjusting includes a means for applying a short duration pulse of microwave energy to said microwave radiating means when said object is in said cavity and a means for measuring the energy of said pulse reflected by said object.

8. A conveyorized heating system, comprising:

a plurality of adjacent microwave cavities;

a microwave radiating means for independently, selectively radiating microwave energy in each of said cavities;

at least one pallet means composed of microwave absorption material for supporting by direct contact an object to be heated;

conveyance means for transporting said at least one pallet means sequentially through said plurality of adjacent cavities;

a selectively operable, microwave and environmentally sealing closure between adjacent pairs of said cavities, closing of said closure permitting independent and arbitrarily different environmental and microwave conditions within ones of said adjacent pair of cavities;

opening means, cooperating with said conveyance means, for selectively and time sequentially opening said closure to permit passage therethrough of said pallet means;

first control means for independently and arbitrarily controlling said environmental and microwave conditions within said cavities;

second programmatic control means for controlling the opening of said closure, the passage of said pallet means through said closure, and the closing of said closure; and thermal sensor means for selectively detecting the thermal environment within each of said cavities, said first control means being responsive to said detected thermal environment, said thermal sensor means is brought into contact with said pallet means.

9. A system as in claim 8 further comprising third control means for independently controlling temperature variations within each of said cavities.

10. A device as in claim 9 wherein said pallet means is composed of microwave absorptive material and wherein said article to be heated is placed in contact with said pallet means.

11. A heating system, comprising:

contiguously located microwave cavities;

a plurality of microwave cavities, each provided with a selectively controllable microwave generating means for generating microwave radiation;

at least one movable pallet for supporting objects to be heated, said pallet fabricated of a heat conductive material which is absorptive of said energy for heating, said pallet has a surface for supporting said objects which conforms to the shape of the objects' surfaces which are placed in contact with said pallet;

a mechanism for moving said at least one pallet serially into and out of said cavities;

a thermocouple placeable into contact with said pallet for measuring the temperature of said pallet while it is in each of said plurality of microwave cavities, said temperature measured by said thermocouple, during the portion of the duty cycle of the microwave generating means during which said microwave generating means is not generating microwave radiation, said microwave generating means includes a means for varying the duty cycle of said microwave generating means in order to produce a predetermined temperature profile as a function of time in said pallet while said pallet is in the corresponding microwave cavity, said means for varying the duty cycle responsive to temperatures measured by said thermocouple;

a member placeable into contact with the tops of objects supported on said pallet when said pallet is within a microwave cavity, said member is made of a material which is absorptive of said energy for heating and conductive of heat; and a means for placing said member into contact with the tops of said objects with a selected pressure.

12. A heating system as in claim 11 further comprising:

a temperature measuring means for measuring the temperature of said pallet while it is in each of said plurality of microwave cavities; and a means for controlling said controllable microwave generating means for heating in response to measurements of temperature of said pallet by said temperature measuring means.

13. A heating system as in claim 12 wherein said temperature measuring means is a thermocouple placeable into contact with said pallet.

14. A heating system as in claim 11 wherein said pallet has a surface for supporting said objects which conforms to the shape of the objects' surfaces which are placed in contact with said pallet.

15. A heating process for objects, comprising:

(1) placing said objects on a movable pallet fabricated from a material absorptive of microwave energy;

(2) moving said pallet into a first microwave cavity provided with a means for generating microwave energy, having a selectable, controllable duty cycle;

(3) initially selecting the duty cycle of said means for generating microwaves so that said pallet reaches a first selected temperature at a predetermined rate;

(4) turning said microwave generating means on with said initially selected duty cycle;

(5) measuring the temperature of said pallet at intervals and controlling said duty cycle after said first selected temperature is reached by said pallet to maintain said pallet at said first selected temperature for a predetermined period of time;

(6) turning said microwave generating means off, said temperature is measured by a thermocouple in contact with said pallet during the portion of the duty cycle when said means for generating microwaves is not generating microwaves;

(7) moving said pallet into a second microwave cavity provided with a means for generating microwave energy having a selectable, controllable duty cycle; and thereafter (8) repeating the above steps (3) through (6) with respect to said second microwave cavity and a second selected temperature.

16. A heating process for objects, comprising:

(1) placing said objects on a movable pallet fabricated from a material absorptive of microwave energy;

(2) moving said pallet into a first microwave cavity provided with a means for generating microwave having a controllable duty cycle, said duty cycle is controlled so that said pallet reaches a predetermined temperature and said means for generating microwaves is turned off when said predetermined temperature is reached;

(3) turning said means for generating microwaves on and controlling its duty cycle so that said pallet is heated according to a predetermined temperature profile; and thereafter (4) turning said means for generating microwaves off after said pallet has been heated through said predetermined temperature profile, said temperature is measured by a thermocouple in contact with said pallet during the portion of the duty cycle when said means for generating microwaves is not generating microwaves, said at least one pallet is a microwave absorptive pallet, said microwave absorptive pallet directly contact a not highly microwave absorptive object to be heated thereon which is to be heated by conduction of heat from said microwave absorptive pallet which is heated by said radiated microwave energy as said microwave absorptive pallet is transported through each cavity.

17. A conveyorized heating system, comprising:

a plurality of adjacent microwave cavities;

microwave radiating means for independently, selectively radiating microwave energy in each of said cavities;

at least one pallet means composed of microwave absorptive material for supporting by direct contact an object to be heated;

conveyance means for transporting said at least one pallet means sequentially through said plurality of adjacent cavities;

a selectively operable, microwave and environmentally sealing closure between adjacent pairs of said cavities, closing of said closure permitting independent and arbitrarily different environmental and microwave conditions within ones of aid adjacent pair of cavities;

opening means, cooperating with said conveyance means, for selectively and time sequentially opening said closures to permit passage therethrough of said pallet means;

first control means for independently and arbitrarily controlling said environmental and microwave conditions within said cavities;

second programmatic control means for controlling the opening of said closure, the passage of said pallet means through said closure, and the closing of said closure;

third control means for independently controlling temperature variations within each of said cavities; and thermal sensor means for separately detecting the thermal environment within each of said cavities, said first control means being responsive to said detected thermal environment, said thermal sensor means is brought into contact with said pallet means.

* * * * *